US012391293B2

(12) United States Patent
Metzger

(10) Patent No.: US 12,391,293 B2
(45) Date of Patent: Aug. 19, 2025

(54) METHOD AND SYSTEM FOR DETERMINING CORRECTION VALUES FOR CORRECTING THE POSITION OF A TRACK

(71) Applicant: Plasser & Theurer Export von Bahnbaumaschinen Gesellschaft m.b.H., Vienna (AT)

(72) Inventor: Bernhard Metzger, Chesapeake, VA (US)

(73) Assignee: Plasser & Theurer Export von Bahnbaumaschinen Gesellschaft m.b.H., Vienna (AT)

( * ) Notice: Subject to any disclaimer, the term of this patent is extended or adjusted under 35 U.S.C. 154(b) by 127 days.

(21) Appl. No.: 18/038,108

(22) PCT Filed: Nov. 8, 2021

(86) PCT No.: PCT/EP2021/080937
§ 371 (c)(1),
(2) Date: May 22, 2023

(87) PCT Pub. No.: WO2022/111983
PCT Pub. Date: Jun. 2, 2022

(65) Prior Publication Data

US 2023/0406377 A1 Dec. 21, 2023

(30) Foreign Application Priority Data

Nov. 25, 2020 (AT) ..... A 51026/2020

(51) Int. Cl.
*B61L 23/04* (2006.01)
*B61K 9/08* (2006.01)
(Continued)

(52) U.S. Cl.
CPC ..... *B61L 23/047* (2013.01); *B61K 9/08* (2013.01); *E01B 29/04* (2013.01); *E01B 35/00* (2013.01)

(58) Field of Classification Search
CPC ..... B61L 23/047; B61K 9/08; E01B 29/04; E01B 35/00
See application file for complete search history.

(56) References Cited

U.S. PATENT DOCUMENTS 5,157,840 A * 10/1992 Henttinen ..... E01B 35/04 33/287
5,598,782 A * 2/1997 Wiseman ..... E01B 35/00 104/2
(Continued)

FOREIGN PATENT DOCUMENTS

DE 10 2007 016 395 B3 7/2008
DE 102008062143 B3 * 5/2010 ..... B61K 9/08
(Continued)

OTHER PUBLICATIONS

International Search Report in PCT/EP2021/080937 dated Mar. 18, 2022 with English translation.
(Continued)

*Primary Examiner* — John M Zaleskas
(74) *Attorney, Agent, or Firm* — Collard & Roe, P.C.

(57) ABSTRACT

The invention relates to a method for determining correction values for correcting a position of a track, with an actual geometry of a track section being recorded by means of an inertial measurement device arranged on a track inspection vehicle while the track is being travelled on, and with measuring data the recorded track section being output by the inertial measurement device to an evaluation device. In this case, a virtual inertial measurement of the same track section with a target geometry is calculated by means of a simulation device in order to obtain simulated measuring
(Continued)

data for the target geometry, with correction values correcting the position of the track being determined by subtracting the simulated measuring data from the measuring data of the inertial measurement device by means of a computing unit. With the method according to the invention, correction values are determined directly on the basis of the measuring data of the inertial measurement device.

10 Claims, 3 Drawing Sheets

(51) Int. Cl.
*E01B 29/04* (2006.01)
*E01B 35/00* (2006.01)

(56) References Cited

U.S. PATENT DOCUMENTS 6,154,973 A * 12/2000 Theurer ..... E01B 27/17 33/651
6,220,170 B1 * 4/2001 Theurer ..... E01B 27/16 104/10
6,260,485 B1 * 7/2001 Theurer ..... E01B 27/17 33/287
6,668,239 B1 * 12/2003 Gilbert ..... B61L 23/047 702/34
10,119,227 B2 11/2018 Lichtberger
2003/0097235 A1 * 5/2003 Theurer ..... G01S 19/51 342/357.34
2017/0306568 A1 * 10/2017 Lichtberger ..... G01C 7/04
2018/0273060 A1 * 9/2018 Corbin ..... G01P 15/14
2018/0339720 A1 * 11/2018 Singh ..... G06T 7/001
2019/0375438 A1 * 12/2019 Auer ..... B61K 9/08
2020/0347557 A1 * 11/2020 Lichtberger ..... E01B 35/10
2020/0354899 A1 * 11/2020 Auer ..... E01B 27/17
2021/0222373 A1 * 7/2021 Lichtberger ..... E01B 29/04
2022/0266881 A1 * 8/2022 Auer ..... G06T 7/60
2022/0315070 A1 * 10/2022 Kuwashiro ..... G01C 19/00
2023/0365170 A1 * 11/2023 Auer ..... B61K 9/08

FOREIGN PATENT DOCUMENTS

EP 1 028 193 A1 8/2000
EP 2305532 A1 * 4/2011 ..... B61K 9/08
EP 3 358 079 A1 8/2018
WO 2016/061602 A1 4/2016
WO WO-2020008525 A1 * 1/2020 ..... B61K 9/08
WO WO-2020037343 A1 * 2/2020 ..... E01B 27/17

OTHER PUBLICATIONS

Austrian Search Report in A 51026/2020 dated Nov. 18, 2021.
Lichtberger B. "Leitcomputer Fuer Stopemaschinen" Eisenbahningenieur, Tetzlaf, Hamburg, DE, vol. 44, No. 7, Jan. 1, 1991 (Jan. 1, 1991), pp. 570-574; ISSN: 0013-2810, XP000910763 p. 570-p. 571 with English summary.

* cited by examiner

METHOD AND SYSTEM FOR DETERMINING CORRECTION VALUES FOR CORRECTING THE POSITION OF A TRACK

CROSS REFERENCE TO RELATED APPLICATIONS

This application is the National Stage of PCT/EP2021/080937 filed on Nov. 8, 2021, which claims priority under 35 U.S.C. § 119 of Austrian Application No. A 51026/2020, filed on Nov. 25, 2020, the disclosure of which is incorporated by reference. The international application under PCT article 21 (2) was not published in English.

FIELD OF TECHNOLOGY

The invention relates to a method for determining correction values for correcting the position of a track, with an actual geometry of a track section being recorded by means of an inertial measurement device arranged on a track inspection vehicle while the track is being travelled on, and with measuring data of the recorded track section being output by the inertial measurement device to an evaluation device. The invention further relates to a system for carrying out the method.

PRIOR ART

With a ballasted track, the local position of a track panel in the ballast bed is affected by travelling and by climatic influences. A specifically provided track inspection vehicle is used to take regular measurements to check a current actual geometry (layout of the track), in particular prior to maintenance work. A suitably equipped track maintenance machine can also be used as a track inspection vehicle. The track geometry is usually defined by the horizontal position (alignment) and the vertical position (track gradient). For determining an absolute track geometry, the position in relation to an external reference system is also required.

Conventional measuring methods use external reference points located next to the track which are attached to fixed structures such as electric poles. Such external reference points can be set as marking bolts or other marking objects. The intended position of each external reference point in relation to the track is documented in directories. In this way, the absolute track geometry is exactly defined on railway main lines (=design geometry of the track).

In addition, a target geometry of the track can be set by means of internal references. This involves the track alignment design being specified by a sequence of track alignment design elements in terms of their length and size. For straight lines, specifying a length is sufficient. Transition curves and curved tracks are each determined by specifying a length and a curved track size. So-called track main points indicate a change between different track alignment design elements, especially for circular and transition curves as well as gradient breaks.

Thus, the horizontal position of the track is composed of the track curvature as a sequence of straight sections, transition curves, and circular curves. The vertical position of the track is determined by specifying the gradient as well as gradient breaks including their vertical curve radii. The superelevation progression of the track is defined by its superelevation sequence including superelevation ramps. When determining the track geometry, superelevation and alignment of the track are harmonized in accordance with the track alignment design guidelines (e.g. EN 13803).

Restoring a desired high-quality track position can be achieved using the so-called precision method. In this method, the exact, absolute track geometry (design geometry) is known through a sequence of defined track alignment design elements and through the geodetic position of the track main points. Prior to a maintenance operation, the existing track geometry and the track position are measured in relation to defined reference points (fixed points). The measuring result is compared with the design geometry, with lifting and lining values for correcting the track position being determined from a detected difference. This method is very accurate and is suitable for high-speed lines that require optimised maintenance. The geometry parameters must be processed reliably and the geodetic reference points must be re-measured regularly.

For cost reasons, the so-called compensation method is used for lines with lower requirements. This method can be carried out without known design geometry of the track. For example, a measuring system of a track tamping machine is used in which measuring chords (moving chords), serving as a reference system are tensioned between measuring trolleys guided on the track. Various embodiments of this moving-chord measuring principle can be found, for example, in DE 10 2008 062 143 B3 or in DE 103 37 976 A1. In this principle, existing track position faults are reduced in relation to the spans of the measuring chords to the longitudinal distance of the measuring trolleys. In 4-point methods, the existing relative track geometry is recorded via an additional measuring chord. A corresponding machine and a method are disclosed in AT 520 795 A1.

In a compensation method with prior track measurement, the existing relative actual geometry of the track is measured with a preliminary run of the track tamping machine or a track inspection vehicle. For this purpose, modern track inspection vehicles use a so-called inertial measurement unit (IMU). An inertial measurement system is described in the technical journal Eisenbahningenieur (52) 9/2001 on pages 6 to 9. DE 10 2008 062 143 B3 also discloses an inertial measurement principle for recording a track position. Based on this measurement, a compensation calculation is carried out in which a previously unknown target geometry is calculated on the basis of the actual geometry.

The actual geometry of the track is usually recorded in the form of a versine and longitudinal-level progression as well as a sequence of superelevation values. Based on this recording, a computing unit calculates an electronic versine compensation, taking into account a previously determined speed category of the track as well as predefined upper limits for displacement and lifting values. The measured versines are smoothed in order to obtain a profile that is as ideal as possible for the given conditions. The position of the transition points between the track alignment design elements (track main points) is determined in the course of the compensation calculation.

In a next step, the resulting displacements and liftings are calculated from the versines by applying a digital filter by which the track must be corrected so that the calculated versine profile can be set. Thus, the results of these further calculations are lifting and lining values (correction values) for correcting the position of the track by means of the track tamping machine.

A disadvantage of a repeated use of the compensation method is the drifting away of the track main points from their original positions (according to the originally determined design geometry). Thus, the ageing of a track leads to an increasing deviation from the original design geometry despite corrections made by means of the compensation method.

Minor position changes of the track main points usually do not pose difficulties. The railway route design often leaves sufficient scope for determining the track position. Difficulties, however, arise with so-called points of restraint or constraints such as bridges, tunnels, or level crossings. There is no scope for relocating the track. According to prior art, it is therefore common to set the displacement values to zero at these points in the compensation calculation.

Presentation of the Invention

The object of the invention is to improve a method of the kind mentioned above in such a way that a determination of correction values for correcting the track position on the basis of measuring values obtained by the inertial measurement device can be carried out in an efficient manner. A further object of the invention is to indicate a corresponding system.

According to the invention, these objects are achieved by way of a method according to claim 1 and a system according to claim 8. Dependent claims indicate advantageous embodiments of the invention.

It is provided that a virtual inertial measurement of the same track section with a target geometry is calculated by means of a simulation device in order to obtain simulated measuring data for the target geometry, with correction values for correcting the position of the track being determined by subtracting the simulated measuring data from the measuring data of the inertial measurement device by means of a computing unit.

With the method according to the invention, correction values are determined directly on the basis of the measuring data of the inertial measurement device with sufficient accuracy. The measuring data of the inertial measurement device are true-to-shape measuring data which directly reflect the track position faults. With the simulated measuring data, comparative values are immediately available for determining the correction data. Thus, the simulation according to the invention leads overall to a significant simplification of the data processing process.

In this context, it is advantageous if the target geometry is given to the simulation device as a sequence of geometric track alignment design elements. For example, a known absolute track geometry (design geometry) is used. The track main points indicate a change of different track alignment design elements. Such track alignment design elements are especially straight lines, circular curves, transition curves, and gradient breaks. For comparing the actual geometry with the target geometry, for example, a stationary coordinate system with the starting point of a measuring run as its origin is selected. Of course, other coordinate systems can also be used for georeferencing.

In a further developed variant of the method, the measuring data of the inertial measurement device are filtered by means of a filter algorithm, with the simulated measuring data being filtered with the same filter algorithm in the simulation device. This is particularly useful for inertial measurement devices with integrated data filtering. In these cases, the output data of the measurement device are already available as filtered measuring data. Therefore, the simulated measuring data are also provided as filtered data in order to obtain correction values through a direct data comparison.

A further improvement provides that in the inertial measurement device, the measuring data are determined on the basis of a virtual regression line with a length between 100 m and 300 m, in particular with a length of 200 m. This data determination allows the method to be used for high-speed lines because long-wave position faults can a Iso be reliably detected.

To increase the data quality, it is useful if the inertial measurement device records measuring data along a measuring path at distances between 15 cm and 50 cm, in particular at a respective distance of 25 cm. This depicts an accurate three-dimensional trajectory of the inertial measurement device moved along the track; very short-wave position faults are also recorded.

For improved georeferencing, it is advantageous if measuring points on the track are recorded as location data by means of a GNSS receiving device arranged on the track inspection vehicle and if the measuring data of the inertial measurement device are linked to the location data. In this way, location-specific measuring data are recorded automatically. These location-specific measuring data of the inertial measurement device can be compared with the simulated measuring data without further processing. It is not necessary to collect further location data (for example by means of an odometer).

In a further development of the method, horizontal lining values and vertical lifting values of the track are derived from the determined correction values for correcting the position by means of the computing unit. These processed correction values can be used directly to actuate a lifting and lining unit of a track maintenance machine to bring the track into a predefined position.

The system according to the invention for carrying out one of the methods described comprises a track inspection vehicle for travelling on a track, with an inertial measurement device for recording a n actual geometry of a track section, with an evaluation device being set up for processing measuring data of the inertial measurement device, with a simulation device being set up for simulating a virtual inertial measurement of the same track section on the basis of a target geometry, and with a computing unit being set up for subtracting the simulated measuring data from the measuring data of the inertial measurement device in order to determine correction values for correcting the position of the track. The system enables a direct determination of correction values at high measuring speeds. Measuring inaccuracies and distortions due to pendulum or chord measurements are prevented. No transmission functions are necessary to compare the data recorded by means of the inertial measurement device with the target geometry. There is also no need to calculate trajectory coordinates because the simulated measuring data are subtracted from the original measuring data of the inertial measurement device.

The inertial measurement device comprises a so-called inertial measurement unit (IMU), which is arranged on a measuring platform of the track inspection vehicle. The exact position of the measuring platform in relation to the rails of the track is determined by means of non-contacting position measuring devices. When using a n inertial measurement unit, it can happen that artefacts occur in the measuring data, especially when driving in curves. These artefacts result from specific features of the inertial measurement method used. If the same inertial measurement method is applied to the target geometry in virtual form, the same artefacts occur. By subsequently subtracting the measuring data to determine the correction values, the artefacts cancel each other out. This reduces the overall computing capacity required because the sometimes time-consuming digital filtering of the measuring data is no longer necessary.

An improvement of the system provides that the track inspection vehicle comprises a GNSS receiving device for recording location data. In this way, the recorded measuring data can be automatically linked with GNSS data in order to perform a location-specific comparison with the simulated measuring data. Specifically, the GNSS receiving device is used to determine the measuring points, at which the measuring values are recorded, in a geodetic reference system.

In an advantageous further development of the system, a communication system is adapted to transmit correction values to a track maintenance machine, with a control device of the track maintenance machine being adapted to process the correction values in order to place the track into the predefined target geometry by means of a controlled lifting and lining unit. This system comprises all components to record an actual geometry, provide correction values, and correct the track position. In this way, a continuous maintenance of a track can be carried out.

BRIEF DESCRIPTION OF THE DRAWINGS

In the following, the invention is explained by way of example with reference to the accompanying figures. The following figures show in schematic illustrations.

DESCRIPTION OF THE EMBODIMENTS

Figure 1:
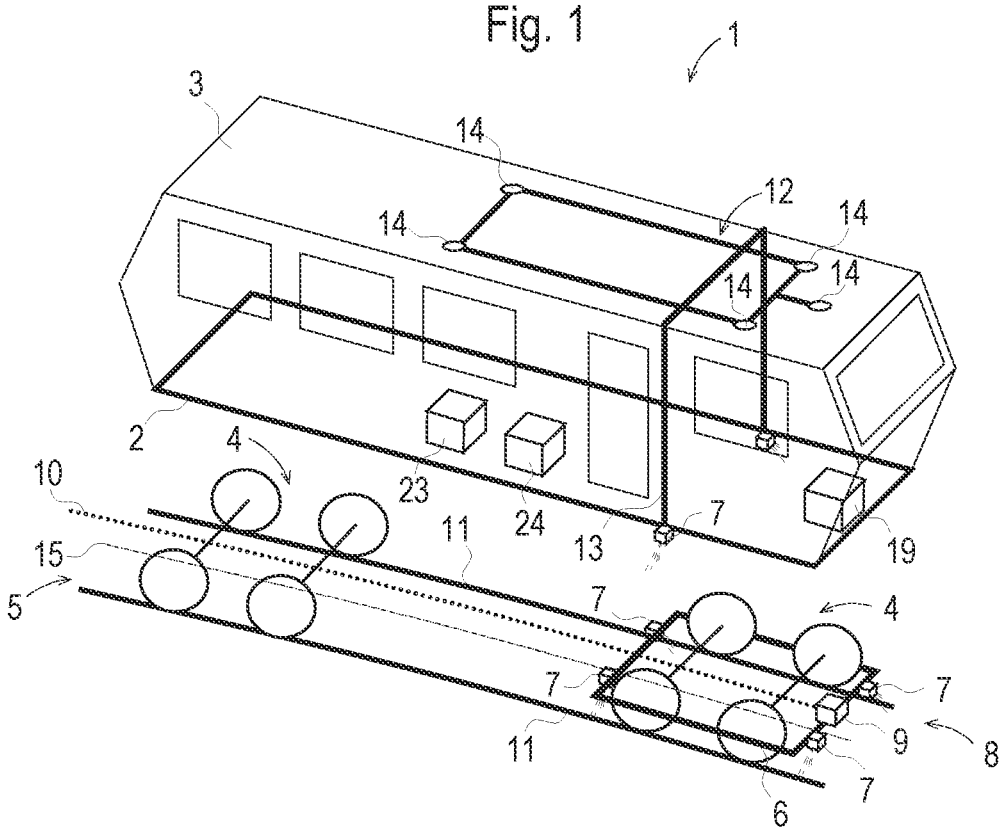
FIG. 1 Track inspection vehicle on a track
Figure 2:
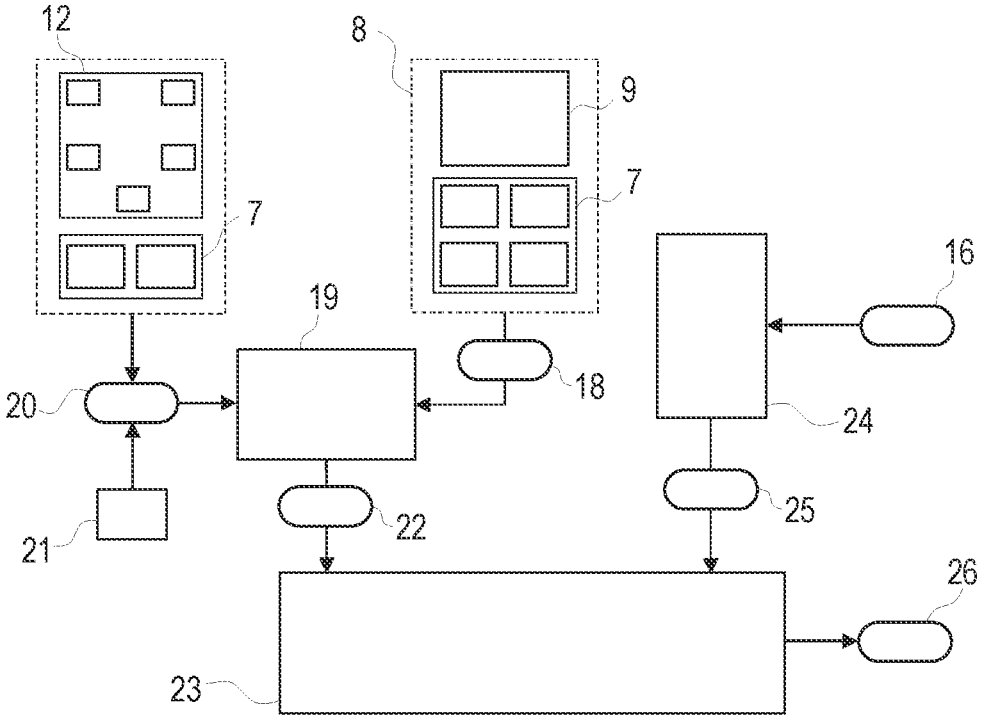
FIG. 2 Block diagram for determining correction values

FIG. 1 shows a track inspection vehicle 1 with a vehicle frame 2 on which a vehicle body 3 is mounted. The track inspection vehicle 1 is movable on a track 5 by means of rail-based running gears 4. For better illustration, the vehicle frame 2 together with the vehicle body 3 is shown in a raised position from the rail-based running gears 4. The vehicle 1 can also be designed as a track maintenance machine, in particular as a tamping machine. In this case, only one machine is required to survey and to correct the track 5.

The rail-based running gears 4 are preferably designed as bogies. A measuring platform 6 is connected to the wheel axles of the bogie as a measuring frame so that movements of the wheels are transmitted to the measuring frame 6 without spring action. Thus, there are only lateral or reciprocal movements of the measuring frame 6 in relation to the track 5. These movements are recorded by means of position measuring devices 7 arranged on the measuring frame 6. They are designed, for example, as laser light-section sensors.

The position measuring devices 7 are components of an inertial measurement device 8 mounted on the measuring platform 6, which comprises an inertial measurement unit 9. Measuring data of an actual geometry 10 of the track 5 are recorded by means of the inertial measurement unit 9 during a measuring run, with relative movements of the inertial measurement unit 9 in relation to the track 5 being compensated for by means of the data from the position measuring devices 7. By means of the measuring results of the position measuring devices 7, the measuring data of the inertial measurement unit 9 can also be transformed to a respective rail 11 of the track 5. The result is an actual geometry 10 for each rail 11.

The track inspection vehicle 1 further comprises a GNSS receiving device 12, by means of which a current position of the track inspection vehicle 1 can be recorded respectively. Due to the known position of the track inspection vehicle 1 in relation to the track 5, the position coordinates of the currently travelled track point can also be recorded. The recorded track points correspond to a sequence of measuring points at which the inertial measurement device 8 collects measuring data.

For example, the GNSS receiving device 12 is rigidly connected to the vehicle frame 2 via a carrier 13. Here, the GNSS receiving device 12 comprises several GNSS antennas 14 aligned towards each other for an accurate recording of GNSS positions of the track inspection vehicle 1. In order to record the reciprocal movements of the vehicle frame 2 in relation to the track 5, further position measuring devices 7 are arranged on the vehicle frame 2. Again in this case, laser light-section sensors are used. For a simple embodiment of the invention, one GNSS antenna 14 is sufficient. This way, actual positions on the track 5 or along a track centreline 15 are continuously recorded.

Alternatively or additionally, the location is recorded by means of an odometer, which can be used to determine a chainage along the measured track section. In any case, this results in location data which will be linked to the measuring data of the inertial measurement device. A comparison with a known target geometry 16 of the track 5 can be performed via this location reference.

For example, a stationary coordinate system is used for georeferencing the measuring results, the origin of which is at the starting point of the measuring run. At the starting point, the X-axis points in the direction of the track 5 to be measured. Crosswise to it, the Y-axis is horizontally aligned. The vertical position of the track 5 results on the Z-axis. During the measuring run, a distance s is further recorded which can be used, in addition to a time stamp, to synchronise the measuring results of the different systems 8, 12. Along a measured track section there are so-called track main points 17. These track main points each mark a boundary between geometric track alignment design elements (e.g. straight line, transition curve, circular curve, or full curve).

The block diagram in FIG. is an exemplary diagram illustrating the system components involved. The measuring data 18 recorded by the inertial measurement device 8 are fed to an evaluation device 19.

Advantageously, a data integration algorithm is set up in the evaluation device 19, by means of which the measuring data 18 of the inertial measurement device 8 as well as GNSS data, or location data 20 of the GNSS receiving device 12, and/or an odometer 21 are linked. It must be ensured that all coordinates are related to a common coordinate system. A system processor is used to jointly evaluate the signals received by the GNSS antennas 19 and to compensate for the relative movements in relation to the track 5.

In one variant of the invention, the inertial measurement device 8 outputs unfiltered measuring data 18 from the inertial measurement unit 9; relative movements of the measuring platform 6 in relation to the rails 11 are compensated. The location-specific measuring data 22 provided by the evaluation device 19 are fed to a computing unit 23.

In addition to this recording of the actual geometry 10, the known target geometry 16 forms the starting point for the further steps of the method. In this case, the target geometry 16 is specified as the optimal virtual track course of a simulation device 24. The simulation device 24 is, for example, a separate computer set up to process virtual scenarios. In order to optimise the hardware, it may also be useful to combine the evaluation device 19, the computing unit 23, and the simulation device 24 into an integrated computer system.

A virtual inertial measurement device is set up in the simulation device 24 which has the same characteristics as the inertial measurement device 8 set up on the measuring platform 6. By means of this virtual inertial measurement device, a virtual measurement of the track course is carried out on the basis of the predefined target geometry 16. For this, the track section is used for which the actual geometry 10 is recorded as well. The real and the virtual measurement device use the same inertial measurement method. The result of the virtual measurement are simulated measuring data 25, which, advantageously, have a location reference in order to perform a direct comparison with the real location-specific measuring data 22.

In the computing unit 23, a location-specific subtraction of the simulated measuring data 25 from the measuring data 18 of the real inertial measurement device 8 takes place. The result of this subtraction are correction values 26 for the track 5 that are used to transform the recorded actual geometry 10 into the desired target geometry 16. In this context, it is advantageous if horizontal lining values and vertical lifting values of the track 5 are derived from the correction values 26 by means of the computing unit 23. For example, the correction values 26 are projected in an XY plane and in a Z direction of the underlying coordinate system. For determining of a superelevation, each rail 11 is assigned its own lifting values.

Subsequently, the lifting and lining values are used to actuate a lifting and lining unit of a track maintenance machine known per se, for example a plain-line or universal tamping machine. Advantageously, a wireless communication system is set up to transmit the correction data 26 determined by means of the track inspection vehicle 1 directly to the track maintenance machine. In another embodiment, the track maintenance machine also comprises all functions of the track inspection vehicle 1 described herein.

For correcting the track position, the track 5 is travelled on by the track maintenance machine after pre-measurement. According to the preset correction values 26, the track panel is placed in its desired position by means of the lifting and lining unit and is fixed in place by means of a tamping unit. A chord measuring system mounted on the track maintenance machine is used to check the track position. In an integrated machine 1, a so-called track geometry guiding computer (also called ALC, automatic guiding computer) comprises the computing unit 23 and the evaluation device 19. The guiding computer serves as the central unit for determining the correction values 26 and for controlling the track maintenance machine.

Figure 3:
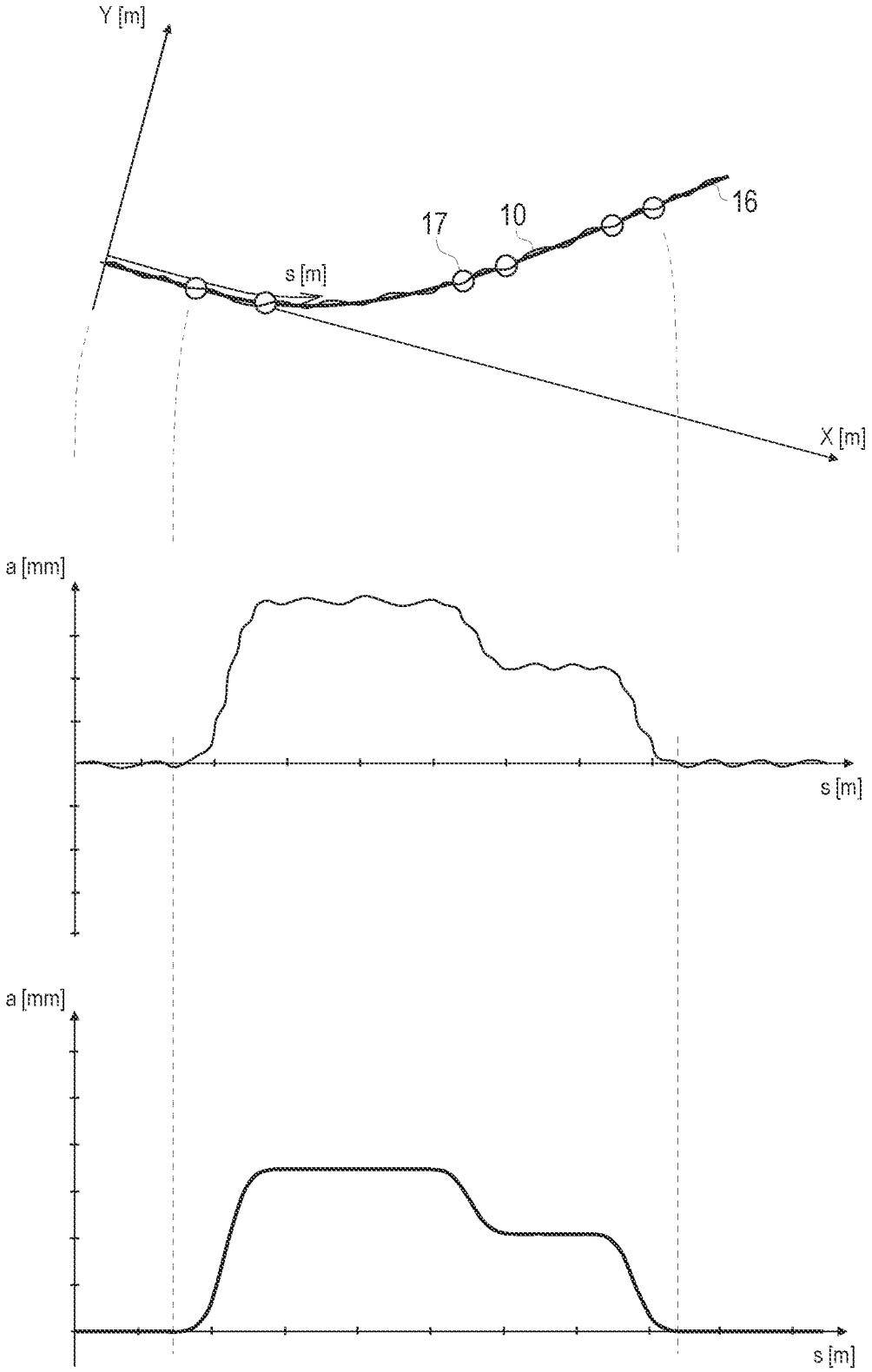
FIG. 3 Diagrams of a track course and unfiltered measuring data

In FIG. 3, the top diagram shows a location diagram of a track section in a stationary coordinate system. The abscissa corresponds to the X-coordinate and the ordinate corresponds to the Y-coordinate. The track section shown begins with a straight line and then changes into a transition curve with increasing curvature until the curvature remains constant in the subsequent first circular curve (full curve). Subsequently, the track section comprises a transition curve with decreasing curvature, a second circular curve, a further transition curve, and a straight line.

The target geometry 16 of the track section predefined for the simulation is shown with a thick continuous line. The individual track alignment design elements are adjacent to each other at track main points 17. With an absolute localisation of the track main points 17, this optimal track position is also referred to as design geometry of the track 5. When specifying a relative target geometry 16, it may be advantageous to define points of restraint in order to determine the track position at level crossings, bridges, tunnels, or similar constraining means. A thin continuous line shows the actual geometry 10 recorded by means of the inertial measurement device 8.

A lateral position of a space curve recorded by mea ns of the inertial measurement device 8 is shown under the depicted location diagram. This is unfiltered measuring data 18, making the course correspond approximately to a curvature diagram (curvature illustration). The distance s is plotted on the abscissa. The ordinate shows the current amplitude a (curvature) above the distance s. A space curve algorithm known per se is used for data recording. This also applies to the inertial measurement system of the company Applanix, which is described in the article mentioned above in the technical journal Eisenbahningenieur (52) 9/2001 on pages 6-9. For example, a 200 m long regression line is chosen in order to calculate an amplitude a at a current measuring point. In the process, a recalculation is carried out along the track 5 every 25 cm, resulting in an exact and almost continuous course of the recorded measuring data 18.

The lowest diagram shows a lateral position of a space curve of the idealised, virtual track 5. In this, the simulated measuring data 25 resulting from a measurement simulation with the virtual measuring device set up in the simulation device 24 are plotted on the ordinate. A regression line with a length of 200 m and a measurement interval of 25 cm is equally used for this simulated measurement. The virtual track measured in the simulation has the predefined target geometry 16.

For the subsequent determination of the correction values 26, measuring data 18, 25 are used for the same track section. A local comparison is made either on the basis of a chainage or on the basis of GNSS data. The correction values 26 then result directly from a subtraction of the two space curves shown.

Figure 4:
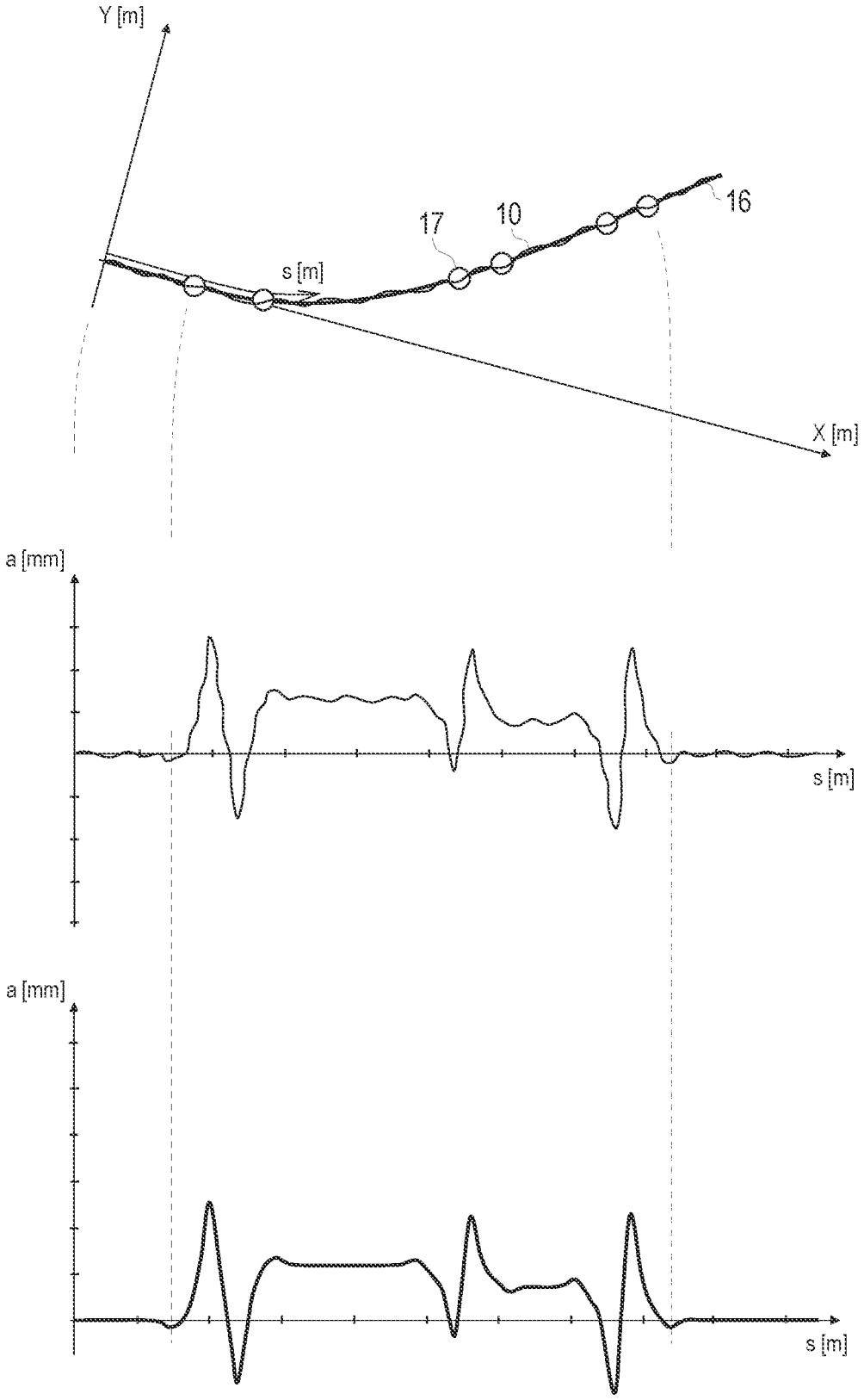
FIG. 4 Diagrams of a track course and filtered measuring data

In another variant, filtered measuring data from the inertial measurement device 8 are used (FIG. 4). With the virtual measurement, the simulated measuring data 25 are filtered in the same way. For example, an FIR filter (finite impulse response filter) is used. Specifications can be found in the European Standard EN 13848. According to this Standard, fault amplitudes in the wavelength range from 70 m to 200 m must also be assessed for lines with a maximum line speed of more than 250 km/h. In the diagrams in FIG. 4, the measuring signal of the inertial measurement device 8 (thin line) and the simulated measuring signal (thick line) are filtered using a band-pass filter with a wavelength range of 3 m to 70 m.

Method-related artefacts can occur in both the real and in the virtual measurement. In the diagrams of the filtered measuring values shown, such artefacts are visible at the transitions between the track alignment design elements. By subtracting the obtained measuring data of the actual geometry 10 and the target geometry 16, these artefacts cancel each other out. As a result, the correction values 26 for the corresponding track section are obtained. By directly subtracting the measuring data 18, there is no need to determine 3D trajectories in the form of XYZ coordinates. This results in a simpler and more accurate method overall for determining the correction values 26, despite the necessary simulation.

The invention claimed is:

1. A method for determining correction values for a position correction of a track, with the steps recording an actual geometry of a track section using an inertial measurement device arranged on a track inspection vehicle while the track is being travelled on, outputting measuring data of the recorded track section by the inertial measurement device to an evaluation device, simulating a virtual inertial measurement of the same track section with a target geometry using a simulation device to obtain simulated measuring data for the target geometry, and determining the correction values for the position of the track by subtracting the simulated measuring data from the measuring data of the inertial measurement device using a computing unit.

2. The method according to claim 1, wherein the target geometry is given to the simulation device as a sequence of geometric track alignment design elements.

3. The method according to claim 1, wherein the measuring data of the inertial measurement device are filtered by means of a filter algorithm and wherein the simulated measuring data are filtered with the same filter algorithm in the simulation device.

4. The method according to claim 1, wherein in the inertial measurement device, the measuring data are determined on the basis of a virtual regression line with a length between 100 m and 300 m.

5. The method according to claim 1, wherein the inertial measurement device records measuring data along a measuring path(s) at distances between 15 cm and 50 cm.

6. The method according to claim 1, wherein measuring points on the track are recorded as location data by means of a GNSS receiving device arranged on the track inspection vehicle and if the measuring data of the inertial measurement device are linked to the location data.

7. The method according to claim 1, wherein horizontal lining values and vertical lifting values of the track are derived from the determined correction values for correcting the position by means of the computing unit.

8. A system for carrying out the method according to claim 1, comprising a track inspection vehicle for travelling on a track, an inertial measurement device arranged on the track inspection vehicle for recording an actual geometry of a track section, an evaluation device being set up to perform processing measuring data of the inertial measurement device, a simulation device is being set up to perform simulating a virtual inertial measurement of the same track section on the basis of a target geometry, and a computing unit being set up to perform subtracting the simulated measuring data from the measuring data of the inertial measurement device to determine correction values for a position correction of the track.

9. The system according to claim 8, wherein the track inspection vehicle comprises a GNSS receiving device for recording location data.

10. The system according to claim 8, wherein a communication system is adapted to transmit the correction values to a track maintenance machine, and wherein a control device of the track maintenance machine is adapted to process the correction values in order to place the track into the predefined target geometry by means of a controlled lifting and lining unit.

* * * * *